US009708905B2

(12) United States Patent
Godager et al.

(10) Patent No.: US 9,708,905 B2
(45) Date of Patent: Jul. 18, 2017

(54) WELLBORE WIRELESS THERMAL CONDUCTIVITY QUARTZ TRANSDUCER WITH WASTE-HEAT MANAGEMENT SYSTEM

(71) Applicant: SENSOR DEVELOPMENT AS, Sandefjord (NO)

(72) Inventors: Øivind Godager, Sandefjord (NO); Mike Serrano, Bellflower, CA (US); Ralph Theron Nelms, Highland Ranch, CO (US)

(73) Assignee: Sensor Developments AS, Sandefjord (NO)

( * ) Notice: Subject to any disclaimer, the term of this patent is extended or adjusted under 35 U.S.C. 154(b) by 0 days.

(21) Appl. No.: 14/732,216

(22) Filed: Jun. 5, 2015

(65) Prior Publication Data

US 2016/0356151 A1 Dec. 8, 2016

(51) Int. Cl.

| | |
|---|---|
| ***G01V 3/00*** | (2006.01) |
| ***E21B 47/12*** | (2012.01) |
| ***E21B 47/06*** | (2012.01) |

(52) U.S. Cl.

CPC ..... *E21B 47/122* (2013.01); *E21B 47/065* (2013.01)

(58) Field of Classification Search

CPC ..... E21B 47/122
USPC ..... 340/854.6
See application file for complete search history.

(56) References Cited

U.S. PATENT DOCUMENTS

| | | | | |
|---|---|---|---|---|
| 3,807,227 | A | 4/1974 | Smith, Jr. | |
| 4,575,260 | A * | 3/1986 | Young | G01N 27/185 374/136 |
| 7,791,419 | B1 * | 9/2010 | Lemkin | H03L 1/027 331/154 |
| 8,912,852 | B2 | 12/2014 | Godager | |
| 2004/0007940 | A1 * | 1/2004 | Tsai | H03H 3/02 310/313 R |
| 2004/0227202 | A1 * | 11/2004 | Pesavento | H01L 41/18 257/416 |

(Continued)

FOREIGN PATENT DOCUMENTS

| | | | |
|---|---|---|---|
| GB | 2466862 | A | 7/2010 |
| WO | WO 2011/067556 | A1 | 6/2011 |

OTHER PUBLICATIONS

Search Report, Norwegian Patent Application No. 20150726, Oct. 31, 2015, 2 pages.

(Continued)

*Primary Examiner* — Santiago Garcia
(74) *Attorney, Agent, or Firm* — Haynes and Boone, LLP

(57) ABSTRACT

Wellbore wireless thermal conductivity quartz transducer comprising a thermal conductivity quartz transducer and a wireless communication system comprising an external device and an internal device, a cable, and a surface device. The thermal conductivity quartz transducer comprises a first quartz resonator, a heat dissipation element, a second quartz resonator, an electronics circuit and heat guiding means arranged for transferring a heat generated by said electronics circuit to said heat dissipation element, so that said dissipation temperature is higher than said ambient temperature. The invention is also a method for wirelessly performing transient response analysis of a formation in a wellbore with such transducer.

16 Claims, 4 Drawing Sheets

(56) References Cited

U.S. PATENT DOCUMENTS

| | | | | |
|---|---|---|---|---|
| 2008/0098795 | A1* | 5/2008 | Orr | G01N 33/0006 73/1.07 |
| 2011/0316522 | A1* | 12/2011 | Shinobu | G01N 5/02 324/109 |
| 2012/0211278 | A1* | 8/2012 | Gonzalez | E21B 47/06 175/40 |
| 2012/0306581 | A1* | 12/2012 | Godager | E21B 47/06 331/56 |
| 2013/0090856 | A1* | 4/2013 | Godager | E21B 41/00 702/11 |
| 2015/0007976 | A1 | 1/2015 | Godager | |
| 2015/0070186 | A1* | 3/2015 | Gonzalez | E21B 47/122 340/854.4 |
| 2015/0377728 | A1* | 12/2015 | Montoya | G01L 9/008 73/702 |
| 2016/0201451 | A1* | 7/2016 | Godager | E21B 49/087 73/152.51 |

OTHER PUBLICATIONS

International Search Report and The Written Opinion of the International Search Authority, or the Declaration, Aug. 26, 2016, PCT/IB2016/053249, 11 pages, ISA/EP.

* cited by examiner

WELLBORE WIRELESS THERMAL CONDUCTIVITY QUARTZ TRANSDUCER WITH WASTE-HEAT MANAGEMENT SYSTEM

FIELD OF THE INVENTION

The present invention relates to the technical field of wellbore wireless thermal conductivity sensors. More specifically the invention relates to quartz based wellbore wireless thermal conductivity sensor systems.

BACKGROUND OF THE INVENTION

Description of the Related Art

Convection, or convective heat transfer, occurs when fluids in motion transfers heat from one place to another. Convection can be both the result of a controlled process, or a means for obtaining a result in a process. In any case, convection, and changes in convection can be important to understand both the process itself and the result of the process.

One example is convection in a wellbore. Convection changes may indicate permeability changes, fluid type changes, thermic changes etc. Since water has a higher thermic conductivity than oil, convection changes may indicate more or less water with regard to the oil.

A thermal anemometer uses a thermic detector to detect the cooling of the fluid passing by the thermic detector to obtain the fluid speed.

The Hot-Wire Anemometer is the most well-known thermal anemometer, and measures a fluid velocity by noting the heat convected away by the fluid. The core of the anemometer is an exposed hot wire, either heated up by a constant current or maintained at a constant temperature. In either case, the heat lost to fluid by convection is a function of the fluid velocity.

By measuring the change in wire temperature under constant current or the current required to maintain a constant wire temperature, the heat lost can be obtained. The heat lost can then be converted into a fluid velocity in accordance with convective theory. Typically, the anemometer wire is made of platinum or tungsten and is 4~10 μm (158~393 μin) in diameter and 1 mm (0.04 in) in length.

Due to the tiny size of the wire, it is fragile and thus suitable only for clean gas flows. In liquid flow or rugged gas flow, a platinum hot-film coated on a 25~150 mm (1~6 in) diameter quartz fiber or hollow glass tube can be used instead.

Another alternative is a pyrex glass wedge coated with a thin platinum hot-film at the edge tip. However thermal anemometers require in general electric power to function. In some remote applications power is not always available and the sensors have to operate with batteries or power harvesting. It is therefore a need to develop thermal conductivity sensors where the requirement for external power is reduced, and where the sensors can be used in harsh environments.

SUMMARY OF THE INVENTION

The invention is a wellbore wireless thermal conductivity sensor system comprising a thermal conductivity sensor and a wireless communication system comprising an external device and an internal device and the external device are configured to be arranged outside the wellbore conduit and the cable are configured to be arranged inside the wellbore conduit comprises:

- a first quartz resonator configured to provide a first temperature signal representing an ambient temperature of the thermal conductivity sensor configured for being in thermal connection with the fluid configured for providing a second temperature signal representing a dissipation temperature of the heat dissipation element arranged for transferring a heat generated by the electronics circuit to the heat dissipation element is higher than the ambient temperature is arranged to transfer the first and second temperature signals via the wireless communication system and the cable (130).

As discussed previously, quartz resonators have a number of beneficial characteristics that can be exploited within the field of sensor technology. Although they have low power requirements, such sensors are dependent on a driver circuit and other electronic circuits to function. These circuits may be powered from a local battery, a power line or by wireless power, i.e. power harvesting from an electromagnetic field.

In a number of applications where power harvesting is used to power the electronics, the efficiency of the wireless power transfer is low, and increasing the transmitted power is not always possible or desirable. The current invention solves this problem by reducing the power requirements on the sensor side by convecting already available superfluous heat from the electronics circuit to a heat dissipation element. Therefore, no additional power is required to detect heat loss from the heat dissipation element. In addition, the wellbore wireless thermal conductivity sensor system according to the invention allows for detection of thermal conductivity changes in remote locations in a wellbore where the conditions are not favorable for anemometers according to prior art.

The thermal conductivity quartz transducer may in an advantageous embodiment be integrated with other sensors, such as e.g. pressure sensors where superfluous heat from electronics circuits in relation to these sensors are used to pre-heat the dissipation element.

The invention is also a method for wirelessly performing transient response analysis of a formation in a wellbore with a wellbore wireless thermal conductivity quartz transducer system utilizing power harwesting, comprising the steps of:

- emitting heat pulses from said heat dissipation element (2) by alternately turning on and off power from said surface device (70) to said wireless link (100); and
- sending said first temperature signal (11*s*) and said second temperature signal (21*s*) to said surface device (70) when said power is on.

This method is advantageous in steady state conditions where e.g. the transducer is cemented in place outside the casing of the wellbore.

BRIEF DESCRIPTION OF THE DRAWINGS

The attached figures illustrate some embodiments of the claimed invention.

DETAILED DESCRIPTION

The invention will in the following be described and embodiments of the invention will be explained with reference to the accompanying drawings.

Figure 1:
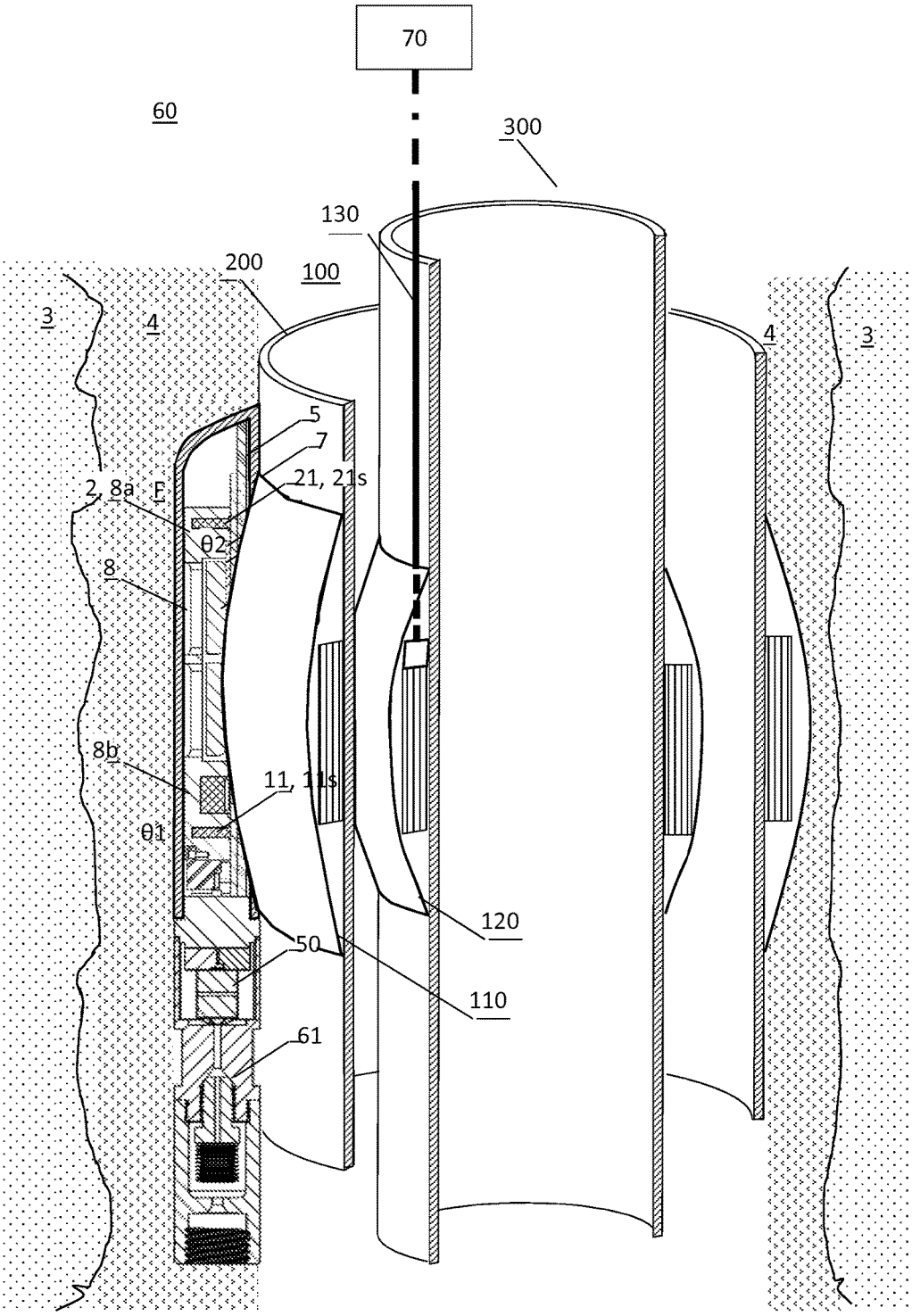
FIG. 1 illustrates a wellbore wireless thermal conductivity sensor system according to an embodiment of the invention.

FIG. 1 illustrates an embodiment of the invention, where the wellbore wireless thermal conductivity quartz transducer (60) is installed in a wellbore (100) with a casing or tubing string (200).

In this embodiment the wireless thermal conductivity sensor system (60) comprises a thermal conductivity quartz transducer (1) and a wireless communication system (100) comprising an external device (110) and an internal device (120), a cable (130), and a surface device (70).

The thermal conductivity quartz transducer (1) and the external device (110) are configured to be arranged outside the wellbore conduit (200), and the internal device (120) and the cable (130) are configured to be arranged inside the wellbore conduit (200).

Figure 2:
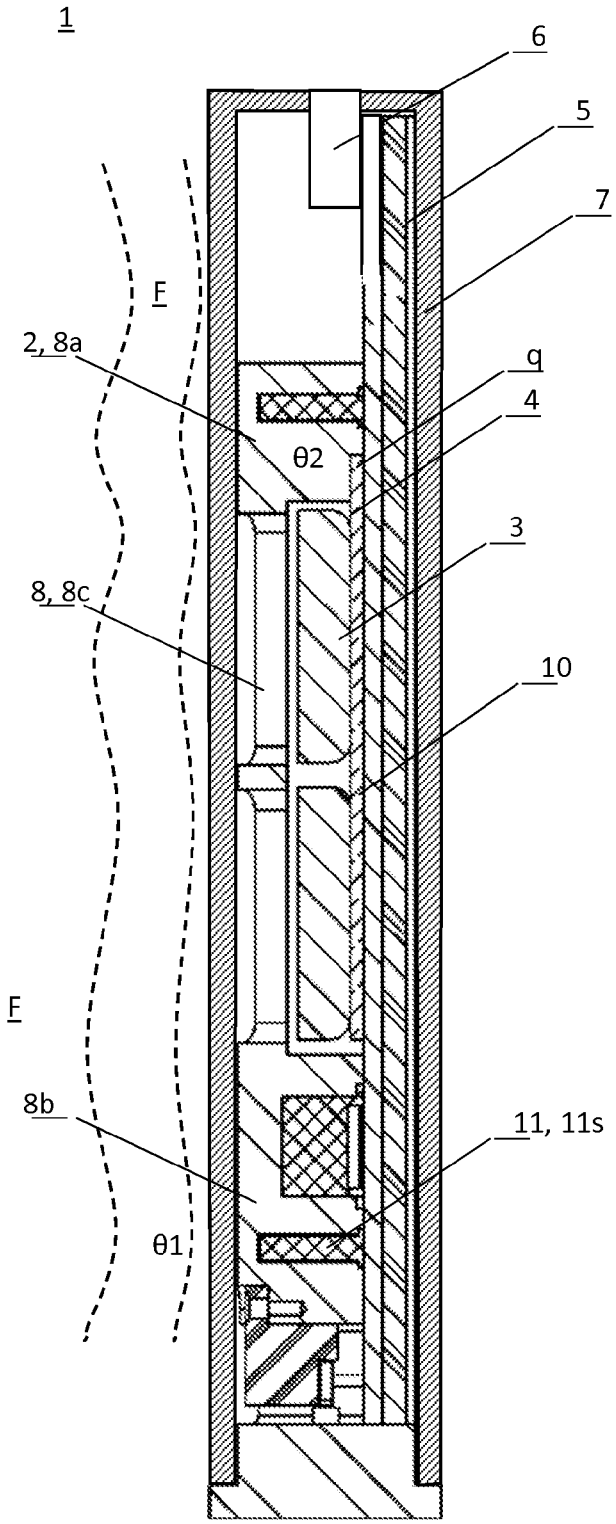
FIG. 2 illustrates an embodiment of the thermal conductivity quartz transducer (1) comprised by the wireless thermal conductivity sensor system.
Figure 3:
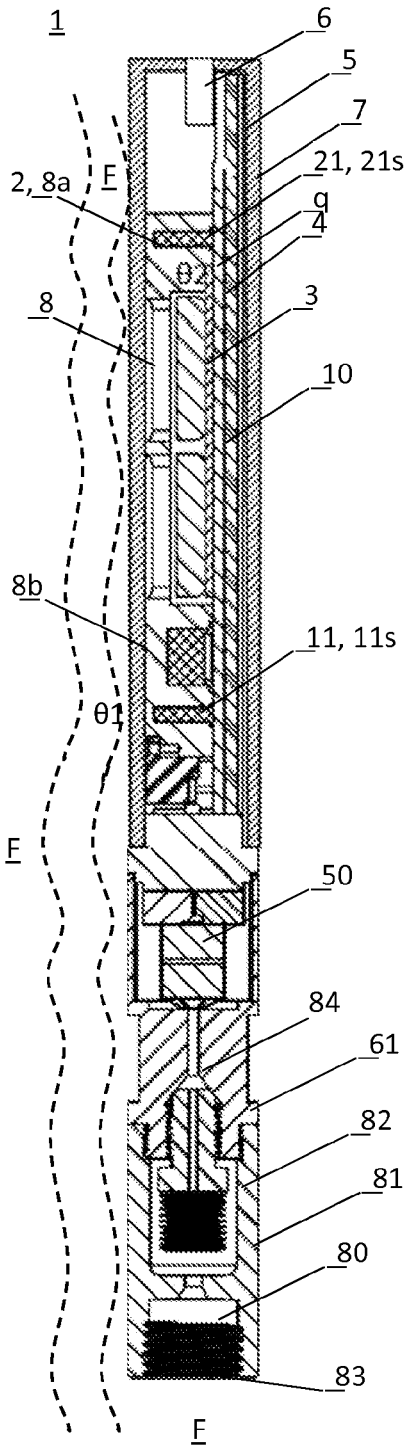
FIG. 3 illustrates a further embodiment of the thermal conductivity quartz transducer (1), where it is integrated with a quartz based pressure sensor.

FIGS. 2 and 3 illustrates two embodiments of a thermal conductivity quartz transducer (1) that can be used in the configuration shown in FIG. 1. They are in principle the same, but FIG. 3 comprises in addition an integrated pressure sensor as will be explained below.

In this embodiment the thermal conductivity quartz transducer (1) comprises a first quartz resonator (11) configured to provide a first temperature signal (11*s*) representing an ambient temperature (θ1) of the thermal conductivity quartz transducer (1). The first quartz resonator (11) is therefore in thermal connection with the fluid (F) outside the sensor (1), and a change in ambient temperature (θ1), i.e. the temperature of the fluid (F), will be detected by the first quartz resonator (11).

Further, the thermal conductivity quartz transducer (1) comprises a heat dissipation element (2) configured for being in thermal connection with the fluid (F) and a second quartz resonator (21) configured for providing a second temperature signal (21*s*) representing a dissipation temperature (θ2) of the heat dissipation element (2).

The thermal conductivity quartz transducer (1) also comprises one or more electronics circuits (3), and heat guiding means (4) arranged for transferring a heat (q) generated by the electronics circuit (3) to the heat dissipation element (2), so that the dissipation temperature (θ2) is higher than the ambient temperature (81).

It should be noted that the dissipation temperature (θ2) represents a temperature of the heat dissipation element (2) and not the fluid temperature. However the fluid temperature will affect the dissipation temperature (θ82) as described below.

The external device (110) is configured for being arranged outside the casing (200) in vicinity of the wellbore stress meter (1), and transmits the first and second temperature signals (11*s*, 21*s*) to the internal device (120) that further communicates with the surface device (70) over the cable (130). The cable (130) is arranged to run inside the wellbore conduit (2).

There are certain problems related to the installation of a cable (130) outside the wellbore conduit (2). If a cable is run alongside the wellbore conduit or casing, it will be subject to stress and strain if the masses outside the conduit slide or move relative the conduit. When the area surrounding the conduit is filled with cement, the problems may increase even further. According to an embodiment of the invention the cable therefore runs along the tubing (300) and wireless transfer is used for both power supply and signal communication between the housing (7) and the surface device (70).

In an alternative embodiment the cable and the internal device (120) runs along a wireline inside the wellbore conduit (200).

Although the wellbore stress meter (1) and the external device (120) may also be displaced relative the internal device (110) on the tubing or wireline, the wireless link will operate within a certain range of displacement.

In an embodiment the wireless communication is established by inductive fields, and the external and internal devices (110, 120) comprises inductive elements such as coils to establish a magnetic field between the devices.

According to an embodiment the external device (110) comprises a first E-field antenna (11), and the internal device (120) comprises a second E-field antenna (21), wherein the first antenna, and the second antenna are arranged for transferring a signal between a first connector of the first E-field antenna and a second connector of the second E-field antenna by radio waves (Ec). The first and second E-field antennas comprises dipole antennas or a first toroidal inductor antennas. The E-field transmission allows less stringent alignment of the first and second antennas, which can reduce the time and cost needed for completion of the wellbore, and allow operation over a wider range of displacement between the external and internal devices (110, 120) described above.

To improve signal transmission between the two devices, the wellbore conduit (200) has in an embodiment a relative magnetic permeability less than 1.05 in a region between the and external and internal devices (110, 120).

In FIGS. 2 and 3, two embodiments of the wellbore stress meter (1) has been illustrated.

The system may also communicate over two annuli by arranging the external device (110) inside the casing (200) wall, wherein an intermediate casing or liner, between the casing (200) and the tubing (300) has relative magnetic permeability less than 1.05 in the region between the external and internal devices (110, 120).

In this embodiment the two temperature sensors used are quartz resonators. Quartz resonators have a high accuracy, and are able to detect small temperature changes. The resonators require driver circuits that has to be powered with electric energy.

In an embodiment the the cable (130) being arranged for transferring electric power to the internal device (120), and the internal device (120) is arranged to provide inductive power to the external device (110), wherein the external device (110) comprises power means for power harvesting the inductive power and for providing power to the electronics circuit (3), such as drivers for the quartz resonators.

However, for a number of applications, such as e.g. when used as a logging tool in a wellbore, the power available is often limited. E.g. if the sensor is battery operated, or powered by power harvesting of a wireless link, higher power requirements would mean shorter battery life or a wireless link with less performance.

According to an embodiment of the invention, the wireless link comprises power harvesting means for power harvesting a power signal from the surface device (70).

According to the invention, heat from the electronics circuit (3) that is necessary for operating the resonators is used directly to heat up the heat dissipation element (2). This heat is in background art treated as excess heat that is deflected out of the sensor and represents a waste of energy.

According to an embodiment, the electronics circuit (3) generating heat therefore comprises a driver circuits for the first and second quartz resonators (11, 21).

In an embodiment the electronics circuit (3) is arranged for generating a constant heat (q) over time. In this way the heat (q) reaching the heat dissipation element (2) via the heat guiding means (4) will also be constant. It will therefore be possible to determine changes in the fluid type and/or fluid velocity as will be described later.

According to an embodiment the quartz resonators of are thickness shear mode resonators (TSMR). TSMR resonators consists of a plate (often circular) of crystalline quartz with thin-film metal electrodes deposited on the faces. The inverse piezoelectric effect is used to produce vibration in response to alternating voltages. For a thickness shear mode resonator, the crystallographic orientation of the disc is selected so that an electric potential applied through the thickness of the disc produces a shear stress.

The dimensions, density, and stiffness of the quartz resonator determine the resonant frequency of vibration. Vibration can be driven at low power because of the low mechanical losses within the material. The resonator, which is often circular, can be supported at the circumference, since the vibration is concentrated in the center.

The resonance frequency of oscillation of the current in a circuit in which the quartz crystal is mounted will change as the temperature of the quartz crystal changes.

The invention makes use of a temperature difference taking place over the transducer, where the difference will vary with external convection. In general the following expression is valid for a system.

Input energy flow−output energy flow+heat supplied−work done=Rate of change of thermic energy.

Thermal resistance R can be defined as:

$$R = \frac{\Delta\theta}{q}$$

Where Δθ is the temperature difference and q is the heat transfer. In the time domain we get the following expression for the temperature difference:

$$\Delta\theta(t)=R\cdot q(t)$$

R can comprise contributions from conduction, convection and radiation.

The heat capacity is given as:

$$C=m\cdot c$$

Where m is the mass of the body and c is the specific heat capacity of a material on a per mass basis.

Coulombs law gives us:

$$\Delta\theta(t) = \frac{1}{C}\int_0^t q(t)\,dt$$

Or $$q(t) = C\cdot\frac{d\Delta\theta}{dt}$$

In the following, the ambient temperature is denoted (θ1), and the inner temperature denoted (θ2). The inner temperature is affected by the heat supplied and dissipated. In general:

$$\theta_1<\theta_2$$

The following equation describes the energy balance for the transducer or sensor arranged in a fluid environment:

$$q_{inn}(t) - q_{nt}(t) = C\cdot\frac{d\theta_2}{dt}$$

$$q_{inn}(t) = \frac{1}{R}((\theta_2(t) - \theta_1(t))$$

Where:

$$R = \frac{1}{h\cdot A}$$

A is the cross section of the sensor, h is the convection heat transfer coefficient and;

$$q_{inn}(t)$$

Is the supplied heat.

The following equation follows from the above:

$$T = \frac{d\Delta\theta_2}{dt} = (\theta_2(t) - \theta_1(t)$$

Where we have introduced the time constant of the sensor:

$$T=R\cdot C$$

T increases when the mass increases and decreases with increasing thermal conductivity, 1/R.

In other words, T will reflect how fast the system reacts to a change in the thermal conductivity, 1/R for the fluid adjacent the sensor.

Different fluids have different heat capacity, which again depends on the heat transfer coefficient h. Further, if the fluid is in motion, the heat capacity will increase, which again will influence the thermal energy balance in the transducer or sensor.

Figure 4:
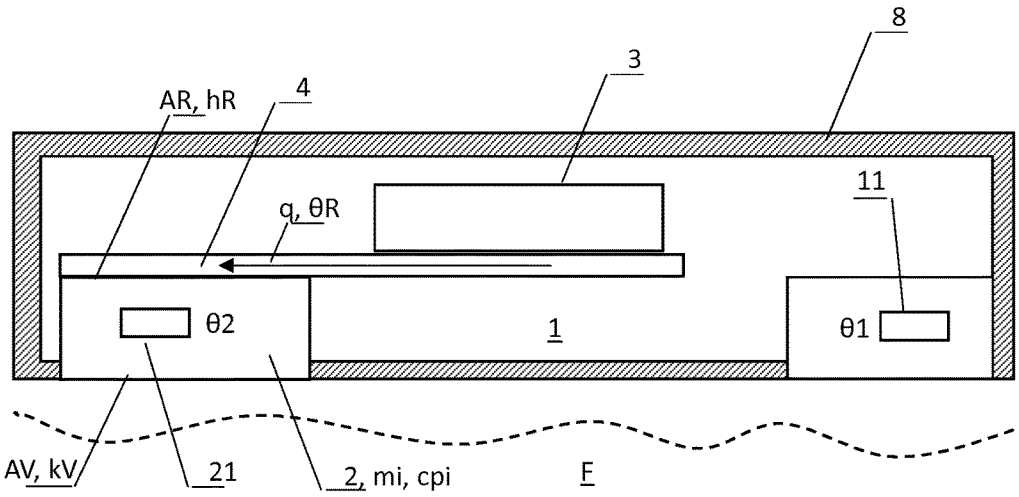
FIG. 4 illustrates the principle used for detection of the thermal conductivity of fluids according to the invention.

The theory applied to determine changes in fluid type or composition, as well as fluid flow in the invention will now be explained in more detail with reference to FIG. 4. According to the invention, two temperature sensors are used, The first temperature sensor (11) senses the ambient temperature (θ1), and the second temperature sensor (21) senses the inner temperature (θ2) affected by the heat supplied in the transducer and the heat dissipated to the surrounding fluids. According to the invention the supplied heat (q) is generated by an electronics circuit (3) and guided by heat guiding means (4), as indicated by the arrow, to the heat dissipation element (2) and from there out into the surrounding fluids. The second temperature sensor (21) is arranged adjacent the heat dissipation element (2) and will therefore sense an inner temperature (θ2) higher than the ambient temperature (θ1) sensed by the first quartz resonator (11) due to the supplied heat (q).

In the following the energy balance of the system (1) according to the invention be derived, where the following definitions are used:

mi: mass of the heat dissipation element (2)

$c_{Pi}$: heat capacity of the heat dissipation element (2)

$A_R$: the effective cross section of the heat dissipation element (2) that the heat (q) from the heat dissipation element (2) is dissipated towards.

$A_V$: effective cross section of the heat dissipation element (2) that dissipates heat towards the adjacent fluid.

$h_R$: heat transfer coefficient of the heat guiding means (4) where the heat guiding means (4) interfaces the heat dissipation element (2).

$k_V$: heat transfer coefficient for the heat dissipation element (2) where the heat dissipation element (2) interfaces the surrounding fluid.

θR: Temperature in heat guiding means (4).

θu=θ1: Ambient temperature in surrounding fluids.

θi=θ2: Temperature sensed by the second quartz resonator (21)

The energy balance of the transducer is:

Supplied energy=Accumulated energy+Dissipated energy, where

Supplied energy is:

$$A_R \cdot h_R \cdot (\theta_R - \theta_i)$$

Dissipated energy is:

$$A_V \cdot k_V \cdot (\theta_i - \theta_u)$$

And accumulated energy is:

$$m_i \cdot c_{P_i} \cdot \frac{d\theta_i}{dt}$$

$$m_i c_{P_i}\left(\frac{d}{dt}\theta_i(t)\right)$$

The total energy balance expressed by the temperature accumulation can be expressed as:

$$m_i \cdot c_{P_i} \cdot \frac{d\theta_i}{dt} = A_R \cdot h_R \cdot (\theta_R - \theta_i) - A_V \cdot k_V \cdot (\theta_i - \theta_u)$$

$$m_i c_{P_i}\left(\frac{d}{dt}\theta_i(t)\right) = A_R h_R(\theta_R - \theta_i(t)) - A_V k_V(\theta_i(t) - \theta_u)$$

$$\frac{d\theta_i}{dt} = \frac{A_R \cdot h_R}{m_i \cdot c_{P_i}} \cdot (\theta_R - \theta_i) - \frac{A_V \cdot k_V}{m_i \cdot c_{P_i}} \cdot (\theta_i - \theta_u)$$

$$\frac{d}{dt}\theta_i(t) = \frac{A_R h_R(\theta_R - \theta_i(t))}{m_i c_{P_i}} - \frac{A_V k_V(\theta_i(t) - \theta_u)}{m_i c_{P_i}}$$

In the case where the electronic circuits generates a constant amount of heat, the only unknown in the transfer function is the heat transfer coefficient (kV) on the interface between the heat dissipation element (2) and the fluid. The heat transfer coefficient (kV) will vary with the properties of the surrounding fluid, and the fluids ability to absorb heat.

The heat transfer coefficient (kV) will therefore vary with heat capacity and thermal conductivity. I.e., if the fluid has a low thermal conductivity the inner temperature (θ2) will increase and the difference between the inner temperature (θ2) and the ambient temperature (θ1) will increase.

If the surrounding fluids have a high thermal conductivity, the temperature difference will decrease and eventually stabilize at a lower level. The same will happen if the transducer is under the influence of a fluid flow, since the flowing fluid has a higher heat dissipation due to a higher heat capacity, i.e. the amount of fluid per time unit increases.

The first and second quartz resonators (11, 21) will have corresponding first and second temperature signals (11*s*, 21*s*). These signals will typically be available through a connector (not shown) in the transducer housing (7). The signals may also be pre-processed, or coded in an electronic circuit before leaving the housing (7). The electronic circuit responsible for signal communication may in an embodiment be arranged in thermal connection with the heat guiding means (4), so that heat dissipated from the circuit can be used to pre-heat the heat dissipation element (2).

Typically the electronic circuits and components of the thermal conductivity quartz transducer (1) are placed on one or more circuit boards (10) as seen in FIG. 1, but they may also be interconnected by wires or shielded cables, such as coaxial cables.

FIG. 3 illustrates an advantageous embodiment of the invention, where the thermal conductivity quartz transducer (1) comprises a third sensor, preferably a quartz resonator with a driver circuit that is thermally connected to the heat guiding means (4), so that the heat, that would normally be wasted for a comparable transducer according to prior art, can be utilized in the thermal conductivity transducer according to the invention.

The third sensor, including the embodiments described below, can be used in combination with all embodiments described above for the thermal conductivity quartz transducer (1).

The additional sensor, or transducer (61), can in an embodiment be a multi-chambered pressure sensor, comprising:

- a first oil filled chamber (80);
- a pressure transfer means (84) between the first oil filled chamber (80) and the pressure sensor (50), arranged to isolate the pressure sensor (50) from the oil filled chamber (80); and
- a pressure permeable filter port (83) through the housing (81) to allow pressure from outside the housing (81) to act on the first oil filled chamber (80).

Thus, the pressure inside the first oil filled chamber (80) will be the same as the pressure outside the housing (81) since a pressure connection has been established through the filter port (83). In this way the internal fluid inside the housing (81) can be hydraulically balanced with pressure outside the pressure sensor even through a layer of cement by relying on hydraulic connectivity.

The pressure transfer means (84) transfers the pressure of the first filled oil chamber (80) to the pressure sensor (50). In an embodiment the pressure transfer means (84) comprises a second oil filled chamber (82).

The permeable filter port (83) is the hydraulic gateway connecting first oil filled chamber (80) to the surrounding formation and automatically equalizes any pressure difference between sensor filter port (83) and the exterior formation pressure.

In an embodiment the filter port (83) is one or more slits through the housing (81).

The filter port (83) is preferably filled with pressure permeable material saturated by a buffer fluid, typically a filling of viscous oil, which provides an excellent pressure transfer fluid to the port surroundings.

Moreover, an additional feature of the filter port (83) when the pressure permeable material is wet and saturated by the oil fill from the first oil filled chamber (80), is that it in turn avoids clogging as it prevents the wellbore grouting cement to bind to the pressure permeable material. In an embodiment the pressure permeable material extends from the filter port (83) outside the housing (81), and increases the filter volume. This feature grants the hydraulic connectivity of the sensor to its surroundings.

In an embodiment the pressure permeable material is hemp fiber, and the slit of the filter port (83) is filled with the hemp fiber.

In an alternative embodiment the pressure permeable material consists of a number of pressure permeable capillary tubes extending radially outwards from the slit.

The sensor (50) is in an embodiment connected electrically to an electronics circuit (3) of the system.

In an embodiment the invention is a method for wirelessly performing transient response analysis of a formation in a wellbore with a wellbore wireless thermal conductivity quartz transducer system (60), comprising the steps of:

emitting heat pulses from said heat dissipation element (2) by alternately turning on and off power from said surface device (70) to said wireless link (100); and sending said first temperature signal (11*s*) and said second temperature signal (21*s*) to said surface device (70) when said power is on. This embodiment relies on power harvesting across the wireless link as described above together with the heat management system for utilizing waste heat to dissipate into the formation or soil. The method is advantageous in steady state systems, e.g. where the transducer is cemented in place outside the casing, and measurements can be based on thermal conduction. Thermal conductivity can then be calculated based on the detected temperature response to the pulsed heat in the cement with its characteristic time delay.

The invention claimed is:

1. A wellbore wireless thermal conductivity quartz transducer system comprising a thermal conductivity quartz transducer and a wireless communication system including an external device and an internal device, a cable, and a surface device, wherein said thermal conductivity quartz transducer and said external device are configured to be arranged outside a wellbore conduit, and said internal device and said cable are configured to be arranged inside said wellbore conduit, wherein said thermal conductivity quartz transducer comprises;

a first quartz resonator configured to provide a first temperature signal representing an ambient temperature of said thermal conductivity quartz transducer;

a heat dissipation element configured for being in thermal connection with a fluid;

a second quartz resonator configured for providing a second temperature signal representing a dissipation temperature of said heat dissipation element;

an electronics circuit; and heat guiding means arranged for transferring a heat generated by said electronics circuit to said heat dissipation element, so that said dissipation temperature is higher than said ambient temperature, wherein said wellbore wireless thermal conductivity quartz transducer is arranged to transfer said first and second temperature signals, to said surface device via said wireless communication system and said cable;

wherein said cable is arranged for transferring electric power to said internal device, said internal device is arranged to provide inductive power to said external device, and said external device comprises power means for power harvesting said inductive power and for providing power to said electronics circuit.

2. The wellbore wireless thermal conductivity quartz transducer system according to claim 1, wherein said electronics circuit is arranged for generating said heat as a constant heat over time.

3. The wellbore wireless thermal conductivity quartz transducer system according to claim 1, wherein said electronics circuit comprises driver circuits for said first and second quartz resonators, wherein said driver circuits are arranged to dissipate waste heat to said heat guiding means.

4. The wellbore wireless thermal conductivity quartz transducer system according to claim 1, wherein said electronics circuit comprises a metallic housing in thermal contact with said heat guiding means.

5. The wellbore wireless thermal conductivity quartz transducer system according to claim 1, further comprising a chassis comprising first and second end blocks, wherein said first end block is said dissipation element and said second end block is housing said first quartz resonator, wherein said first and second end blocks are interconnected by a middle section with a smaller cross section than said first and second end blocks.

6. The wellbore wireless thermal conductivity quartz transducer system according to claim 5, wherein said chassis is made of Inconel.

7. The wellbore wireless thermal conductivity quartz transducer system according to claim 5, further comprising a cylindrical housing about said chassis.

8. The wellbore wireless thermal conductivity quartz transducer system according to claim 1, wherein said first quartz resonator is arranged to resonate in thickness shear mode.

9. The wellbore wireless thermal conductivity quartz transducer system according to claim 7, wherein said first quartz resonator is AT, BT, AC or Y-cut.

10. The wellbore wireless thermal conductivity quartz transducer system according to claim 1, further comprising a third quartz resonator with a driver circuit that is thermally connected to said heat guiding means and arranged to dissipate waste heat to said heat guiding means.

11. The wellbore wireless thermal conductivity quartz transducer system according to claim 10, further comprising a pressure sensor, wherein said third quartz resonator is configured to sense pressure changes in said fluid.

12. A method for wirelessly performing transient response analysis of a formation in a wellbore with a wellbore wireless thermal conductivity quartz transducer system according to claim 1, comprising:

emitting heat pulses from said heat dissipation element by alternately turning on and off power from said surface device to said wireless communication system; and sending said first temperature signal and said second temperature signal to said surface device when said power is on.

13. The wellbore wireless thermal conductivity quarts transducer system according to claim 1, wherein said external device is a first E-field antenna having a first connector and said internal device is a second E-field antenna having a second connector.

14. The wellbore wireless thermal conductivity quartz transducer system according to claim 13, wherein a signal is transferred between said first and second connectors by radio waves.

15. The wellbore wireless thermal conductivity quartz transducer system according to claim 14, wherein said signal is transferred between said first and second connectors when said first connector is slightly unaligned from said second connector.

16. A method for wirelessly performing transient response analysis of a formation in a wellbore with a wellbore wireless thermal conductivity quartz transducer system, the method comprising:

emitting heat pulses from a heat dissipation element by alternately turning on and off power from a surface device to a wireless communication system;

sending a first temperature signal representing an ambient temperature of a thermal conductivity quartz transducer from a first quartz resonator and a second temperature signal representing a dissipation temperature of said heat dissipation element from a second quartz resonator to said surface device when said power is on;

heating said heat dissipation element with superfluous heat generated by an electronics circuit by said electronics circuit, so that said dissipation temperature is higher than said ambient temperature; and reducing power used to detect heat loss from said heat dissipation element.

* * * * *